US010119198B2

(12) United States Patent
Fujikata et al.

(10) Patent No.: US 10,119,198 B2
(45) Date of Patent: Nov. 6, 2018

(54) METHOD OF CLEANING SUBSTRATE HOLDER

(71) Applicant: EBARA CORPORATION, Tokyo (JP)

(72) Inventors: Jumpei Fujikata, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 185 days.

(21) Appl. No.: 15/163,588

(22) Filed: May 24, 2016

(65) Prior Publication Data

US 2016/0265135 A1 Sep. 15, 2016

Related U.S. Application Data

(62) Division of application No. 13/943,984, filed on Jul. 17, 2013, now Pat. No. 9,376,760.

(30) Foreign Application Priority Data

Jul. 18, 2012 (JP) ..... 2012-159205

(51) Int. Cl.

| | |
|---|---|
| ***C25D 21/08*** | (2006.01) |
| ***C25D 17/06*** | (2006.01) |
| ***B08B 3/08*** | (2006.01) |
| *C25D 5/12* | (2006.01) |
| *C25D 17/00* | (2006.01) |

(52) U.S. Cl.

CPC ..... *C25D 21/08* (2013.01); *B08B 3/08* (2013.01); *C25D 17/06* (2013.01); *C25D 5/12* (2013.01); *C25D 17/001* (2013.01)

(58) Field of Classification Search

None

See application file for complete search history.

(56) References Cited

FOREIGN PATENT DOCUMENTS

| | | | |
|---|---|---|---|
| JP | 58-092374 | U | 6/1983 |
| JP | 61-159083 | U | 10/1986 |
| JP | 63-166990 | A | 7/1988 |
| JP | 2002-249896 | A | 9/2002 |
| JP | 2004-183042 | A | 7/2004 |
| JP | 2008-045179 | A | 2/2008 |
| JP | 2011-105968 | A | 6/2011 |

OTHER PUBLICATIONS

EPO machine translation of JP2004183042 (Year: 2004).*

* cited by examiner

*Primary Examiner* — Eric W Golightly

(74) *Attorney, Agent, or Firm* — Baker & Hostetler LLP

(57) ABSTRACT

A method of cleaning a substrate holder comprises suspending the substrate holder in a substrate holder cleaning bath while the substrate holder holds a dummy substrate with a sealing member sealing a peripheral portion of the dummy substrate. The dummy substrate has a larger area of contact with a substrate contact portion of the sealing member and has a larger area of contact with a substrate contact portion of an electrical contact of the substrate holder than those of a substrate to be plated. The method further comprises supplying a cleaning liquid into the substrate holder cleaning bath until the substrate holder is immersed in the cleaning liquid to clean the substrate holder. Different types of cleaning liquids are individually and sequentially supplied into the substrate holder cleaning bath to clean the substrate holder sequentially with the cleaning liquids.

4 Claims, 8 Drawing Sheets

METHOD OF CLEANING SUBSTRATE HOLDER

CROSS REFERENCE TO RELATED APPLICATION

This application claims priority to and is a Divisional of U.S. Application Ser. No. 13/943,984 filed on Jul. 17, 2013, and issued as U.S. Pat. No. 9,376,760 on Jun. 28, 2016, which claims priority to Japanese Patent Application No. 2012-159205, filed Jul. 18, 2012, the entire content of which is hereby incorporated by reference.

BACKGROUND OF THE INVENTION

Field of the Invention

The present invention relates to a plating apparatus and a method of cleaning a substrate holder, and more particularly to a dip-type plating apparatus in which a substrate, such as a semiconductor wafer, held by a substrate holder is immersed in a plating solution to form e.g., connecting bumps or interconnects on a surface of the substrate, and to a method for cleaning a substrate holder for use in such a plating apparatus.

Description of the Related Art

Electroplating is widely used to form connecting bumps at predetermined positions on a surface of a substrate, such as a semiconductor wafer. As shown in FIGS. 1 and 2, a substrate W is prepared with a seed layer 200 formed as a feeding layer on the substrate surface, a resist 202 coating the surface of the seed layer 200, and openings 202*a* formed at predetermined positions in the resist 202. While sealing a peripheral portion of the surface of the substrate W with a sealing member 204 mounted to a substrate holder, a plating area A of the substrate surface, surrounded by the sealing member 204, is brought into contact with a plating solution. A metal 206, which is used as bumps, is formed by plating on exposed surfaces of the seed layer 200, lying inside the resist openings 202*a* in the plating area A.

When the peripheral portion of the surface of the substrate W is sealed with the sealing member 204 of the substrate holder in this manner, the sealing member 204 may bridge over those resist openings 202 which lie in the peripheral portion of the surface of the substrate W. This would generally be unavoidable because of the necessity for securing the largest possible effective surface area of the substrate W. When the metal 206 is formed in the openings 202*a* over which the sealing member 204 bridges, the metal 206 may be deposited abnormally and reach a top surface of the resist 202, resulting in adhesion of an over-deposited metal 207 to the sealing member 204. The metal 207 adhering to the sealing member 204 grows every time plating of a substrate is performed.

If the substrate holder is used continuously with the metal 207 left on the sealing member 204, there will be a deficiency of a thickness or poor in-plane uniformity of a metal film formed on a substrate surface. Furthermore, leakage of a plating solution can occur when the plating area A of the substrate surface, surrounded by the sealing member 204, is immersed in the plating solution. It is therefore necessary to clean the substrate holder, periodically or as needed, to remove the metal 207 from the sealing member 204.

When the substrate holder is used in plating of a substrate having no resist film formed on the substrate surface, the seed layer 200 directly contacts the sealing member 204 of the substrate holder. Therefore, the metal 207, abnormally deposited on the substrate surface, may adhere to the sealing member 204.

In common practice, therefore, during maintenance work of the substrate holder, the substrate holder is cleaned manually, or with a cleaning liquid (chemical liquid) capable of dissolving the metal 207. Upon the maintenance work, in general, the substrate holder is removed from the plating apparatus and cleaning of the substrate holder and periodic replacement of parts are carried out.

A cleaning apparatus for automatically cleaning a suspended jig has been proposed. The cleaning apparatus includes a film-removing solution bath, a water bath, an acid cleaning bath, etc. arranged in this order in a space in which the suspended jig is transported by a transport means (see Japanese Laid-Open Utility Model Publication No. 58-92374). A cleaning apparatus has been proposed which, instead of a common dip or immersion method, employs a jet method in which a cleaning liquid is jetted toward a cleaning object (see Japanese Laid-Open Utility Model Publication No. 61-159083). A workpiece transport system has been proposed which allows a pallet, holding workpieces, to pass through a water-cleaning section, and then immerses the pallet in a pool of water and stores the pallet therein so as to prevent drying and oxidation of the workpieces (see Japanese Laid-Open Patent Publication No. 63-166990). A liquid processing apparatus has been proposed in which a substrate holder, holding a substrate, is moved from a processing bath to a cleaning section, where the substrate holder is cleaned together with the processing surface of the substrate (see Japanese Laid-Open Patent Publication No. 2002-249896).

The applicant has proposed a plating apparatus having a substrate holder cleaning section for cleaning a substrate holder in an open state, not holding a substrate. The plating apparatus can automatically clean the substrate holder without removing it from the plating apparatus (see Japanese Laid-Open Patent Publication No. 2008-45179).

An operation of the plating apparatus needs to be stopped in order to remove the substrate holder from the apparatus and clean the substrate holder. Even if a spare substrate holder is provided, the plating apparatus needs to be stopped at least during replacement of the substrate holder, resulting in a lowered productivity of the plating apparatus. In addition, it is laborious to remove the substrate holder from the plating apparatus.

The above-mentioned patent documents are not directed to a technique for automatically cleaning a substrate holder when it is stored in a plating apparatus, i.e. without taking the substrate holder out of the plating apparatus.

When a substrate holder in an open state, not holding a substrate, is cleaned as described in the Japanese Laid-Open Patent Publication No. 2008-45179, an electrical contact which is kept in contact with a seed layer of a substrate to feed electricity to the seed layer, will become wet with a cleaning liquid. If an electrical contact in a wet state comes into contact with a seed layer of a substrate, the seed layer may dissolve at its contact portion with the electrical contact, leading to a decrease in the electrical conduction between the electrical contact and the seed layer. An electrical contact must therefore be in a dry state upon contact with a seed layer. Thus, a substrate holder with an electrical contact in a wet state cannot be used until the electrical contact becomes dry. It is generally quite difficult to dry the electrical contact, located inside the substrate holder, in a short time.

In a case of using a plating apparatus which is configured to perform multi-layer composite plating on a surface of a substrate held by the substrate holder, a metal 207 (see FIG. 2), composed of different types of metals, may be abnormally deposited on the sealing member of the substrate holder. In most cases, no common cleaning liquid can effectively dissolve and remove the metal 207 composed of different types of metals. Therefore, different types of cleaning liquids should be used to clean the substrate holder. However, a plurality of cleaning baths for the different types of cleaning liquids should be provided for removing the different types of metals abnormally deposited on the sealing member of the substrate holder, thus considerably increasing a footprint of the plating apparatus.

SUMMARY OF THE INVENTION

The present invention has been made in view of the above situation. It is therefore an object of the present invention to provide a plating apparatus capable of cleaning a substrate holder with a cleaning liquid while keeping the plating apparatus in operation without removing the substrate holder from the plating apparatus and without wetting an electrical contact of the substrate holder with the cleaning liquid, and to provide a method for cleaning the substrate holder.

In order to achieve the object, the present invention provides a plating apparatus including: a plating bath configured to store a plating solution therein; a substrate transport device configured to remove a substrate before plating from a substrate cassette and return the substrate after plating to the substrate cassette; a substrate holder configured to detachably hold the substrate with a sealing member sealing a peripheral portion of the substrate and immerse the substrate in the plating solution in the plating bath; a dummy substrate arranged in a position accessible by the substrate transport device; and a substrate holder cleaning bath configured to immerse the substrate holder in a cleaning liquid to clean the substrate holder when holding the dummy substrate with the sealing member sealing a peripheral portion of the dummy substrate.

By thus cleaning the substrate holder with the cleaning liquid that has been supplied into the cleaning bath, a metal adhering to the sealing member of the substrate holder can be removed without stopping the operation of the plating apparatus and without removing the substrate holder from the apparatus. Furthermore, by cleaning the substrate holder holding the dummy substrate while sealing the peripheral portion of the dummy substrate with the sealing member, the substrate holder can be cleaned with the cleaning liquid while preventing an electrical contact(s), provided in the substrate holder, from becoming wet with the cleaning liquid.

In a preferred embodiment of the present invention, the substrate holder cleaning bath is configured to individually supply different types of cleaning liquids and a rinsing liquid into the substrate holder cleaning bath.

When different types of metals, e.g. a first metal and a second metal, are attached to the sealing member of the substrate holder, the substrate holder can be cleaned in the following manner. A first cleaning liquid, which is capable of dissolving the first metal, is supplied into the substrate holder cleaning bath to clean the substrate holder, followed by rinsing of the substrate holder with a rinsing liquid, and thereafter a second cleaning liquid, which is capable of dissolving the second metal, is supplied into the substrate holder cleaning bath to clean the substrate holder, followed by rinsing of the substrate holder with a rinsing liquid. Thus, the substrate holder cleaning bath can effectively dissolve and remove different types of metals, adhering to the sealing member of the substrate holder, without incurring an increase in a footprint of the plating apparatus.

In a preferred embodiment of the present invention, the substrate holder cleaning bath serves as a storage bath for storing the substrate holder therein.

The use of such substrate holder cleaning bath can avoid an increase in the footprint of the plating apparatus.

In a preferred embodiment of the present invention, the substrate holder is one of a plurality of substrate holders, the plating bath is operable to plate substrates with use of a part of the plurality of substrate holders, and the substrate holder cleaning bath is operable to clean other part of the plurality of substrate holders.

In a preferred embodiment of the present invention, the dummy substrate is stored in a substrate cassette which is arranged in a position accessible by the substrate transport device.

With this structure, it is not necessary to provide the dummy substrate in the plating apparatus, and the dummy substrate can be carried into the plating apparatus just before its use for cleaning of the substrate holder.

The present invention also provides a method of cleaning a substrate holder including: suspending a substrate holder in a substrate holder cleaning bath, the substrate holder holding a dummy substrate with a sealing member sealing a peripheral portion of the dummy substrate; and supplying a cleaning liquid into the substrate holder cleaning bath until the substrate holder is immersed in the cleaning liquid to clean the substrate holder.

In a preferred embodiment of the present invention, different types of cleaning liquids and a rinsing liquid are individually and sequentially supplied into the substrate holder cleaning bath to clean the substrate holder sequentially with the cleaning liquids.

According to the present invention, the substrate holder can be cleaned with the cleaning liquid while keeping the plating apparatus in operation, without removing the substrate holder from the apparatus and without wetting an electrical contact, provided in the substrate holder, with the cleaning liquid. It therefore becomes possible to prevent a decrease in the throughput of the plating apparatus due to cleaning of substrate holders.

DETAILED DESCRIPTION OF THE PREFERRED EMBODIMENTS

Embodiments of the present invention will now be described in detail with reference to the drawings. The following description illustrates an exemplary case where bumps of a Cu—Ni—SnAg alloy are formed at predetermined positions on a surface of a substrate, such as a semiconductor wafer, by sequentially carrying out copper plating, nickel plating, and Sn—Ag alloy plating on the substrate surface. It is noted that the present invention is not limited to the use of such plating metals.

Figure 3:
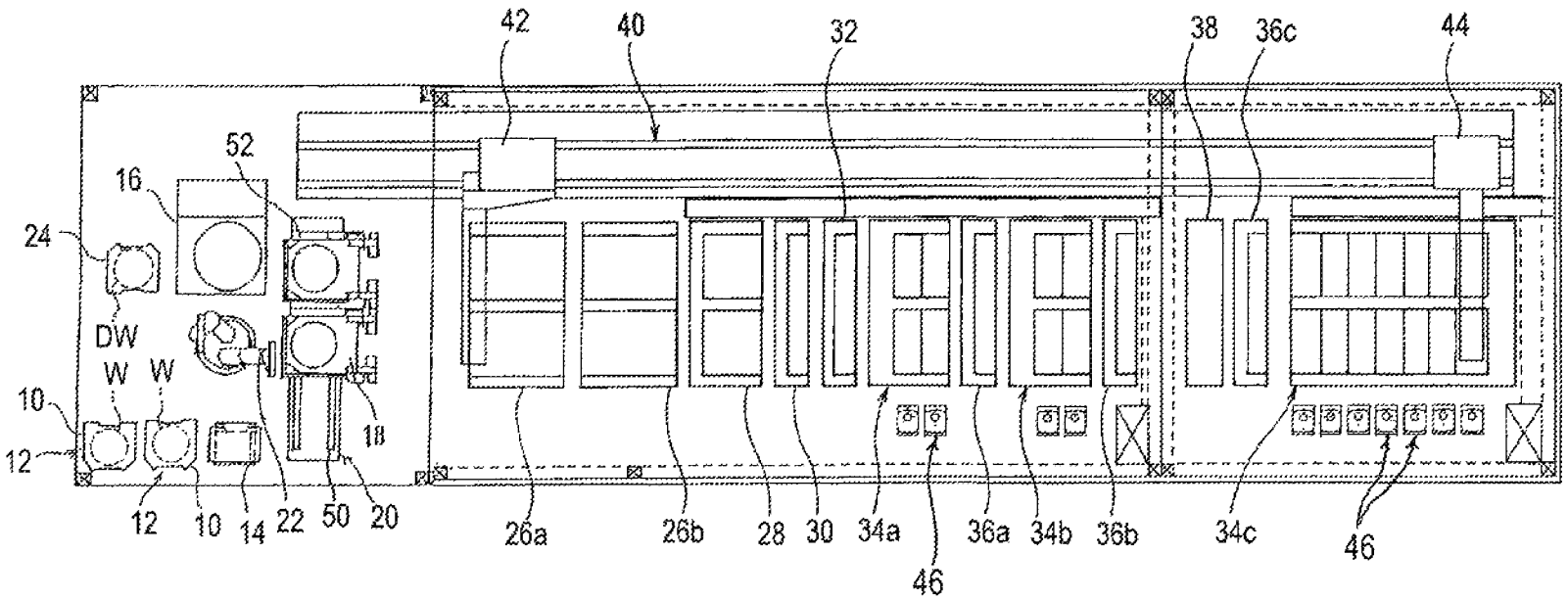
FIG. 3 is an overall layout plan view of a plating apparatus according to an embodiment of the present invention.
Figure 4:
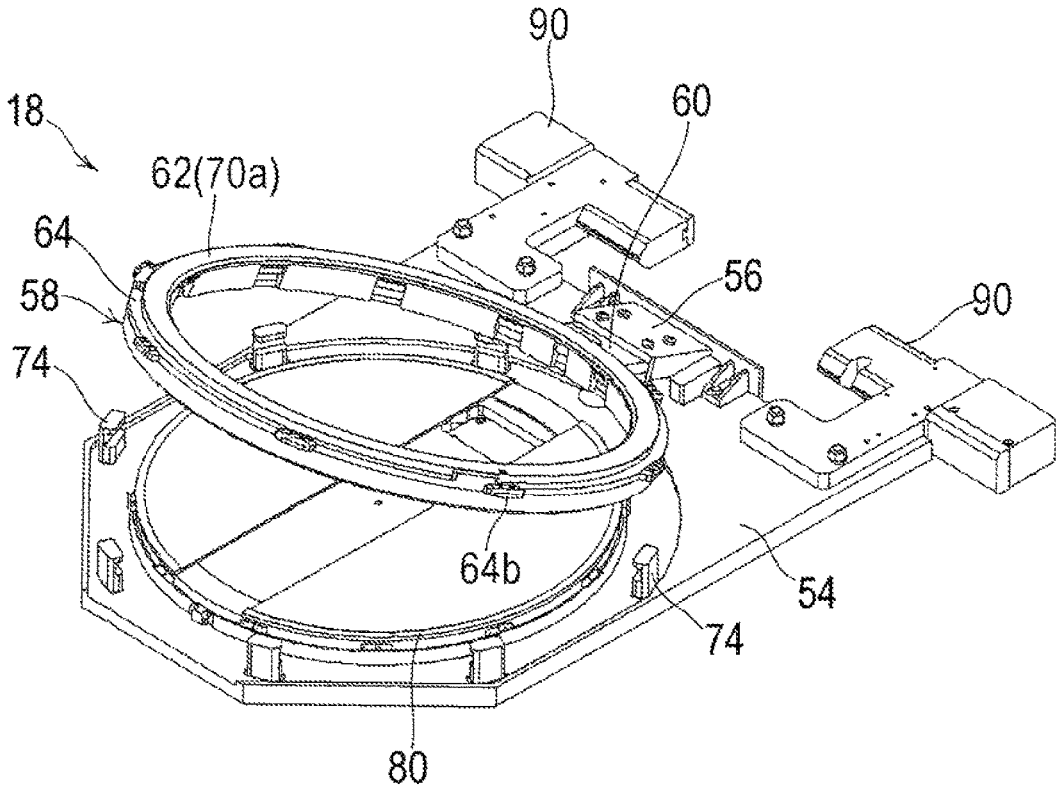
FIG. 4 is a schematic perspective view of the substrate holder shown in FIG. 3.

FIG. 3 shows an overall layout plan of a plating apparatus according to an embodiment of the present invention. As shown in FIG. 3, the plating apparatus includes two cassette tables 12 on which substrate cassettes 10, each storing substrates W, such as semiconductor wafers, are placed, an aligner 14 for aligning an orientation flat or a notch of a substrate W in a predetermined direction, and a spin drier 16 for drying the substrate W after plating by rotating it at a high speed. Near these units is provided a substrate loading unit 20 for placing a substrate holder 18 thereon and loading the substrate W into the substrate holder 18 and removing the substrate W from the substrate holder 18. Further, in the center of these units is disposed a substrate transport device 22 constituted by a transport robot for transporting the substrate W between these units.

A dummy substrate cassette 24 in which dummy substrates DW are stored is disposed adjacent to the substrate transport device 22 so that the substrate transport device 22 is accessible to the dummy substrates DW stored in the dummy substrate cassette 24. A dummy substrate DW is a non-patterned substrate having the same shape as the substrate W, and may be a bare silicon substrate or a substrate having a silicon oxide layer formed on its surface. As with the substrate W, the dummy substrate DW is attached to and removed from the substrate holder 18 by the substrate loading unit 20. The number of dummy substrates DW is larger than the number of substrate holders 18 to be cleaned at a time.

The plating apparatus further includes a first substrate holder cleaning bath 26*a* and a second substrate holder cleaning bath 26*b*, each of which serves not only as a cleaning bath but also as a storage bath for storing and temporarily storing substrate holders 18 therein, a pre-wetting bath 28 for immersing a substrate in pure water to enhance hydrophilicity of the surface of the substrate, a pretreatment bath 30 for carrying out a pre-plating treatment of the surface of the substrate, a pretreatment solution water-cleaning bath 32 for removing a pretreatment solution adhering to the substrate and the substrate holder 18, a Cu plating bath 34*a* for holding a Cu plating solution therein and carrying out electroplating of the surface of the substrate to form a Cu film on the substrate surface, a first water-cleaning bath 36*a* for removing the Cu plating solution adhering to the substrate and the substrate holder 18, an Ni plating bath 34*b* for holding an Ni plating solution therein and carrying out electroplating of the surface of the substrate to form an Ni film on the surface of the Cu film, a second water-cleaning bath 36*b* for removing the Ni plating solution adhering to the substrate and the substrate holder 18, a blow bath 38 for cleaning the substrate surface with pure water and then removing the pure water from the surface (by air blowing), an Sn—Ag alloy plating bath 34*c* for holding an Sn—Ag alloy plating solution therein and carrying out electroplating of the surface of the substrate to form an Sn—Ag alloy film on the surface of the Ni film, and a third water-cleaning bath 36*c* for removing the Sn—Ag alloy plating solution adhering to the substrate and the substrate holder 18. These baths are arranged in this order starting from the one nearest to the substrate loading unit 20.

A cleaning liquid, which is capable of dissolving a metal 207 (see FIG. 2) adhering to a sealing member, is supplied into the pretreatment bath 30. An aqueous solution of sulfuric acid and hydrogen peroxide may be used as the cleaning liquid in order to dissolve copper. An aqueous solution of sodium hydroxide may be used as the cleaning liquid in order to dissolve nickel. A 30-50 wt % aqueous solution of nitric acid or an aqueous solution of methanesulfonic acid may be used as the cleaning liquid in order to dissolve the Sn—Ag alloy. The pretreatment solution water-cleaning bath 32 is provided with a blowing mechanism for blowing air toward the substrate holder 18, holding a substrate after water cleaning, while moving the substrate holder 18 upward, to remove pure water adhering to the substrate and the substrate holder 18. In this embodiment a large number of Sn—Ag alloy plating baths 34*c* are provided so as to increase an operating rate.

Located lateral to the above baths, there is provided a substrate holder transport device 40, driven e.g., by a linear motor, for transporting the substrate holder 18, together with a substrate, between the baths. The substrate holder transport device 40 has a first transporter 42 for transporting a substrate between the substrate loading unit 20 and the substrate holder cleaning baths 26*a* and 26*b*, and a second transporter 44 for transporting the substrate between the substrate holder cleaning baths 26*a* and 26*b*, the pre-wetting bath 28, the pretreatment bath 30, the water-cleaning baths 32, 36*a*, 36*b*, and 36*c*, the plating baths 34*a*, 34*b*, and 34*c*, and the blow bath 38. The substrate holder transport device 40 may be provided with only the first transporter 42 without being provided with the second transporter 44.

Paddle driving devices 46 are provided each for driving a paddle (not shown) disposed in each of the plating baths 34*a*, 34*b*, and 34*c* as an agitator for agitating a plating solution. The paddle driving devices 46 are located at the opposite side of the substrate holder transport device 40.

The substrate loading unit 20 includes a flat stage plate 52 which is laterally slidable along rails 50. Two substrate holders 18, parallel to each other, are placed horizontally on the stage plate 52. After one substrate is transferred between one substrate holder 18 and the substrate transport device 22, the stage plate 52 is slid laterally and the other substrate is transferred between the other substrate holder 18 and the substrate transport device 22.

As shown in FIGS. 4 through 7, the substrate holder 18 includes a first holding member (base holding member) 54 having a rectangular plate shape and made of e.g., vinyl chloride, and a second holding member (movable holding member) 58 rotatably coupled to the first holding member 54 through a hinge 56 which allows the second holding member 58 to open and close with respect to the first holding member 54. Although in this embodiment the second holding member 58 is configured to be openable and closable through the hinge 56, it is also possible to dispose the second holding member 58 opposite to the first holding member 54 and to move the second holding member 58 away from and toward the first holding member 54 to thereby open and close the second holding member 58.

The second holding member 58 includes a base portion 60 and a ring-shaped seal holder 62. The seal holder 62 is made of vinyl chloride so as to enable a retaining ring 64, which will be described later, to slide well. An inwardly-projecting substrate-side (inner-side) sealing member 66 is fixed to an upper surface of the seal holder 62. The substrate-side sealing member 66 is placed in pressure contact with a peripheral portion of the surface of the substrate W to seal a gap between the substrate W and the second holding member 58 when the substrate W is held by the substrate holder 18. A holder-side (outer-side) sealing member 68 is fixed to a surface, facing the first holding member 54, of the seal holder 62. This holder-side sealing member 68 is placed in pressure contact with the first holding member 54 to seal a gap between the first holding member 54 and the second holding member 58 when the substrate W is held by the substrate holder 18. The holder-side sealing member 68 is located outwardly of the substrate-side sealing member 66.

Figure 7:
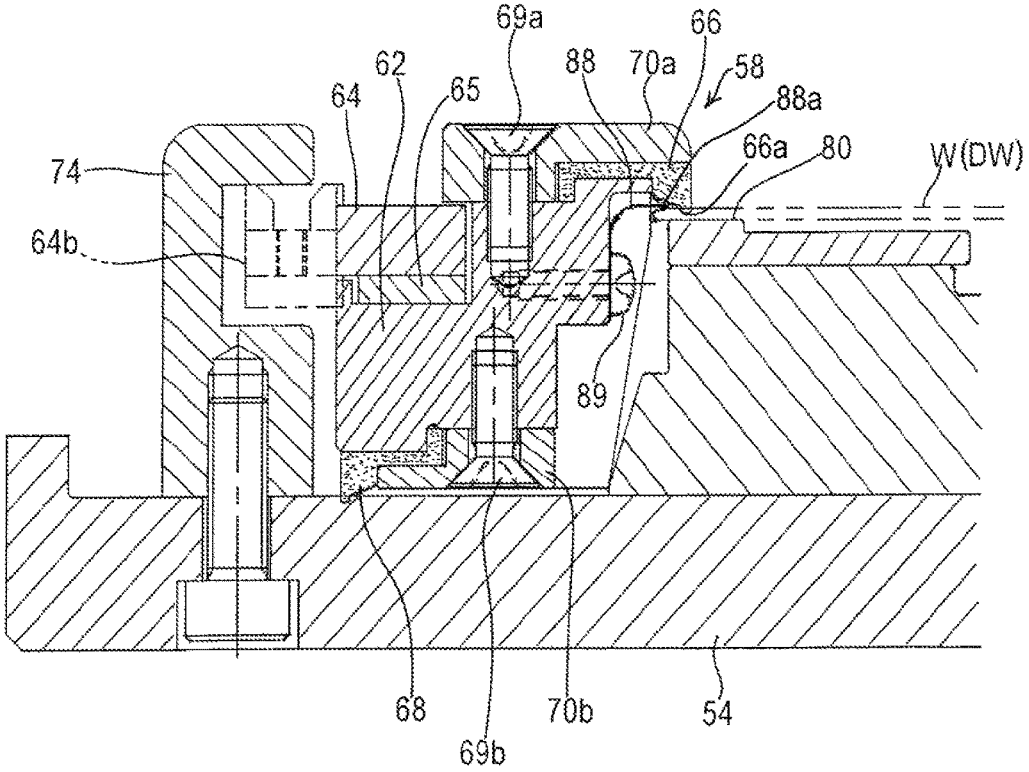
FIG. 7 is an enlarged view of a portion A shown in FIG. 6.

As shown in FIG. 7, the substrate-side sealing member 66 is sandwiched between the seal holder 62 and a first mounting ring 70*a* which is secured to the seal holder 62 by fastening tools 69*a*, such as bolts. The holder-side sealing member 68 is sandwiched between the seal holder 62 and a second mounting ring 70*b* which is secured to the seal holder 62 by fastening tools 69*b*, such as bolts.

The seal holder 62 of the second holding member 58 has a stepped portion at a periphery thereof, and the retaining ring 64 is rotatably mounted to the stepped portion via a spacer 65. The retaining ring 64 is inescapably held by the first mounting ring 70*a*. This retaining ring 64 is made of a material having high rigidity and excellent acid corrosion resistance, for example titanium, and the spacer 65 is made of a material having a low friction coefficient, for example PTFE, so that the retaining ring 64 can rotate smoothly.

Inverted L-shaped clampers 74, each having an inwardly projecting portion and located outside of the retaining ring 64, are provided on the first holding member 54 at equal intervals along a circumferential direction of the retaining ring 64. The retaining ring 64 has outwardly projecting portions 64*b* arranged along the circumferential direction of the retaining ring 64 at positions corresponding to positions of the clampers 74. A lower surface of the inwardly projecting portion of each clamper 74 and an upper surface of each projecting portion 64*b* of the retaining ring 64 are tapered in opposite directions along the rotational direction of the retaining ring 64. A plurality (e.g., four) of upwardly protruding dots 64*a* are provided on the retaining ring 64 in predetermined positions along the circumferential direction of the retaining ring 64. The retaining ring 64 can be rotated by pushing and moving each dot 64*a* from a lateral direction by means of a rotating pin (not shown).

When the second holding member 58 is open, the substrate W is inserted into the central portion of the first holding member 54, and the second holding member 58 is then closed through the hinge 56. Subsequently the retaining ring 64 is rotated clockwise so that each projecting portion 64*b* of the retaining ring 64 slides into the inwardly projecting portion of each clamper 74. As a result, the first holding member 54 and the second holding member 58 are fastened to each other and locked by engagement between the tapered surfaces of the projecting portions 64*b* of the retaining ring 64 and the tapered surfaces of the clampers 74. The lock of the second holding member 58 can be released by rotating the retaining ring 64 counterclockwise to disengage the projecting portions 64*b* of the retaining ring 64 from the inverted L-shaped clampers 74.

When the second holding member 58 is locked in the above-described manner, the lower end of the inner downwardly-protruding portion of the substrate-side sealing member 66 is placed in pressure contact with the peripheral portion of the surface of the substrate W held by the substrate holder 18. As a result, the substrate-side sealing member 66 is uniformly pressed against the substrate W to seal the gap between the substrate W and the second holding member 58. Similarly, when the second holding member 58 is locked, the lower end of the outer downwardly-protruding portion of the holder-side sealing member 68 is placed in pressure contact with the surface of the first holding member 54, whereby the holder-side sealing member 68 is uniformly pressed against the first holding member 54 to seal the gap between the first holding member 54 and the second holding member 58.

The dummy substrate DW is held by the substrate holder 18 in the same manner. Specifically when the second holding member 58 is open, the dummy substrate DW is inserted into the central portion of the first holding member 54, and the second holding member 58 is then closed through the hinge 56. Subsequently the retaining ring 64 is rotated clockwise so that each projecting portion 64*b* of the retaining ring 64 slides into the inwardly projecting portion of each clamper 74. As a result, the first holding member 54 and the second holding member 58 are fastened to each other and locked by engagement between the tapered surfaces of the projecting portions 64*b* of the retaining ring 64 and the tapered surfaces of the clampers 74. The lock of the second holding member 58 can be released by rotating the retaining ring 64 counterclockwise to disengage the projecting portions 64*b* of the retaining ring 64 from the inverted L-shaped clampers 74.

When the second holding member 58 is locked in the above-described manner, the lower end of the inner downwardly-protruding portion of the substrate-side sealing member 66 is placed in pressure contact with the peripheral portion of the surface of the dummy substrate DW held by the substrate holder 18. As a result, the substrate-side sealing member 66 is uniformly pressed against the dummy substrate DW to seal the gap between the dummy substrate DW and the second holding member 58. Similarly, when the second holding member 58 is locked, the lower end of the outer downwardly-protruding portion of the holder-side sealing member 68 is placed in pressure contact with the surface of the first holding member 54, whereby the holder-side sealing member 68 is uniformly pressed against the first holding member 54 to seal the gap between the first holding member 54 and the second holding member 58.

The first holding member 54 has a protruding portion 82 in a ring shape corresponding to a size of the substrate W. The protruding portion 82 has a support surface 80 which contacts the peripheral portion of the substrate W to support the substrate W. The protruding portion 82 has recesses 84 arranged at predetermined positions along a circumferential direction of the protruding portion 82.

Figure 5:
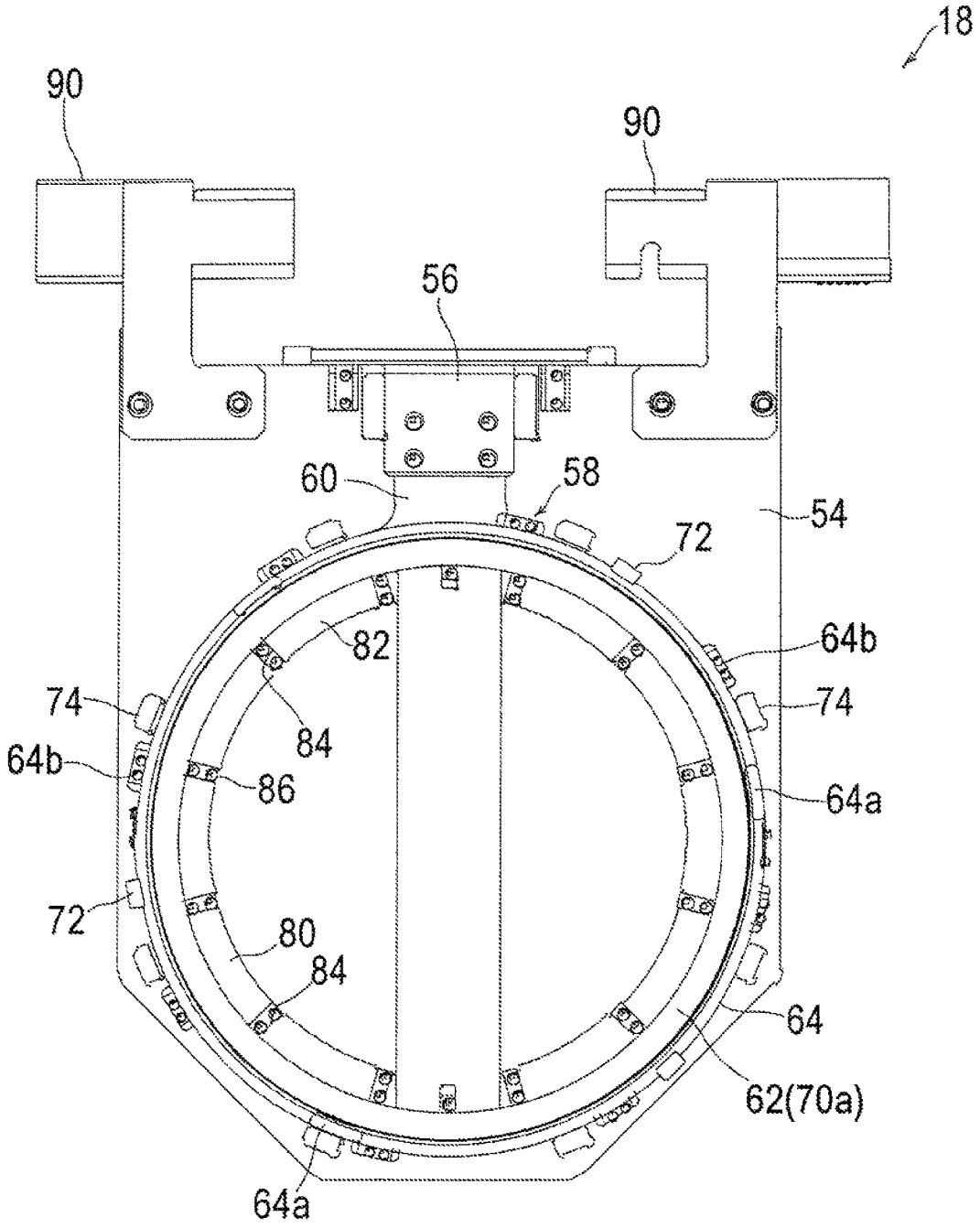
FIG. 5 is a plan view of the substrate holder shown in FIG. 3.
Figure 6:
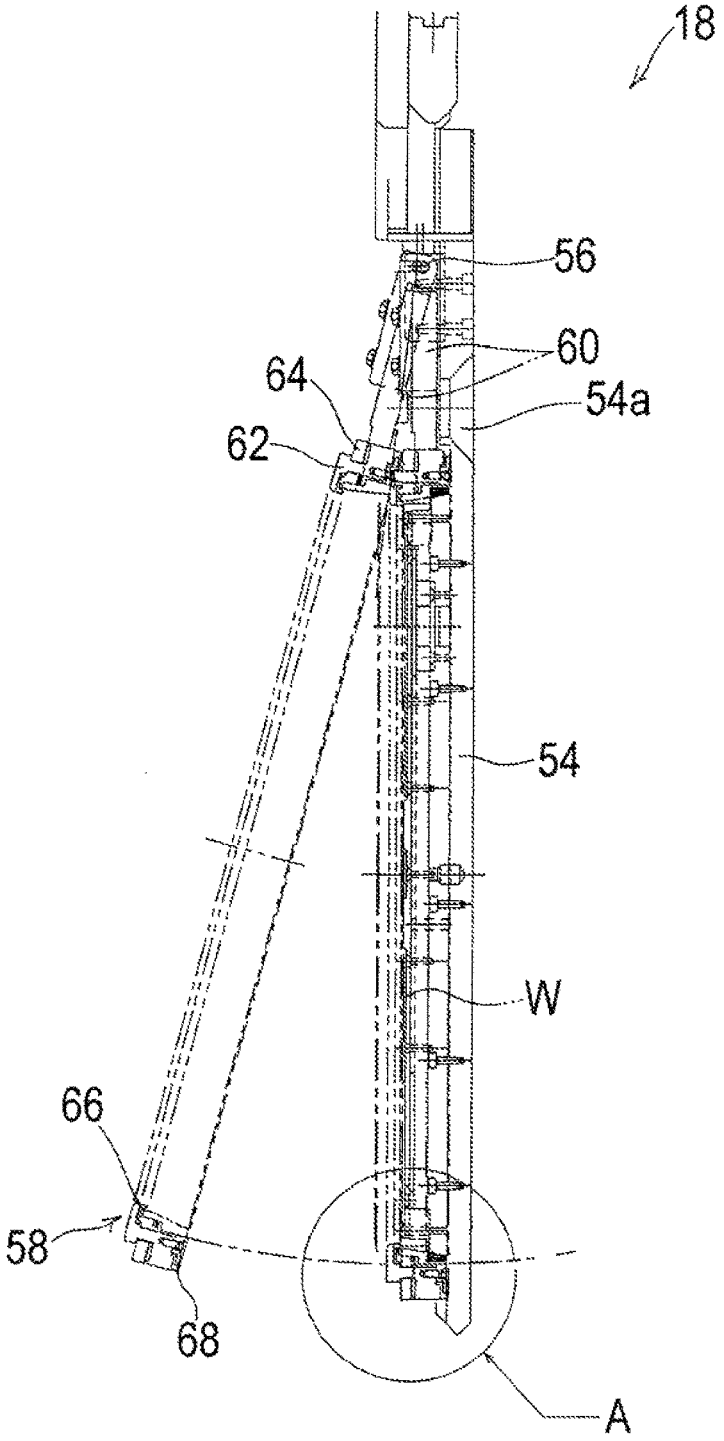
FIG. 6 is a right side view of the substrate holder shown in FIG. 3.

As shown in FIG. 5, a plurality of electrical conductors (electrical contacts) 86 (e.g., 12 conductors as illustrated), coupled respectively to wires extending from connection terminals provided on a hand 90, are disposed in the recesses 84 of the protruding portion 82. When the substrate W is placed on the support surface 80 of the first holding member 54, ends of the electrical conductors 86 contact lower portions of the electrical contacts 88 shown in FIG. 7.

The electrical contacts 88, to be electrically connected to the electrical conductors 86, are secured to the seal holder 62 of the second holding member 58 by fastening tools 89, such as bolts. The electrical contacts 88 each have a leaf spring-like contact portion lying outside the substrate-side sealing member 66 and projecting inwardly. This contact portion is springy and bends easily. When the substrate W is held by the first holding member 54 and the second holding member 58, the contact portions of the electrical contacts 88 make elastic contact with the peripheral surface of the substrate W supported on the support surface 80 of the first holding member 54.

The second holding member 58 is opened and closed by a not-shown pneumatic cylinder and by the weight of the second holding member 58 itself. More specifically, a through-hole 54*a* is formed in the first holding member 54, and the pneumatic cylinder is provided so as to face the through-hole 54*a* when the substrate holder 18 is placed on the stage plate 52 of the substrate loading unit 20. The second holding member 58 is opened by extending a piston rod of the pneumatic cylinder to lift up a pressing rod (not shown) through the through-hole 54*a* to thereby push up the seal holder 62 of the second holding member 58. The second holding member 58 is closed by its own weight when the piston rod is retracted.

A pair of approximately T-shaped hands 90 is coupled to the ends of the first holding member 54 of the substrate holder 18. These hands 90 serve as a support when the substrate holder 18 is transported and when the substrate holder 18 is held in a suspended state. In the substrate holder cleaning baths 26*a* and 26*b*, outwardly projecting ends of the hands 90 are placed on an upper surface of a peripheral wall of each bath, whereby the substrate holder 18 is suspended in a vertical position. When the substrate holder 18 is transported, the hands 90 of the suspended substrate holder 18 are gripped by the first transporter 42 of the substrate holder transport device 40. Also in the pre-wetting bath 28, the pretreatment bath 30, the water-cleaning baths 32, 36*a*, 36*b*, and 36*c*, the plating baths 34*a* and 34*b*, and the blow bath 38, the substrate holder 18 is suspended with the hands 90 placed on peripheral walls of these baths.

Figure 8:
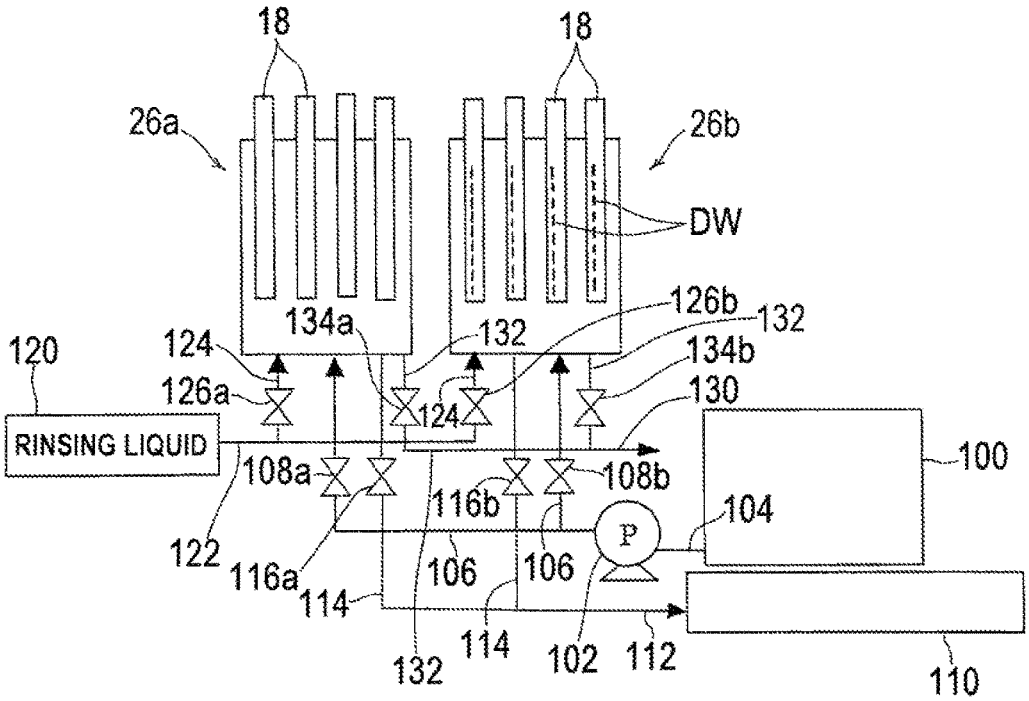
FIG. 8 is a schematic view of substrate holder cleaning baths provided in the plating apparatus shown in FIG. 3.

FIG. 8 is a schematic view showing the first substrate holder cleaning bath 26*a* and the second substrate holder cleaning bath 26*b*. As shown in FIG. 8, branch lines 106 are coupled respectively to the first substrate holder cleaning bath 26*a* and the second substrate holder cleaning bath 26*b*. The branch lines 106 branch off from a cleaning liquid supply line 104, which extends from a cleaning liquid tank 100 that stores a cleaning liquid therein and is provided with a pump 102. The branch lines 106 are provided with on-off valves 108*a* and 108*b*, respectively. Branch lines 114 are coupled respectively to the first substrate holder cleaning bath 26*a* and the second substrate holder cleaning bath 26*b*. These branch lines 114 branch off from a cleaning liquid discharge line 112 which extends from a cleaning liquid reservoir 110. The branch lines 114 are provided with on-off valves 116*a* and 116*b*, respectively.

In this embodiment, a 30-50 wt % aqueous solution of nitric acid or a 10 wt % aqueous solution of methanesulfonic acid, which is capable of dissolving the Sn—Ag alloy, is used as the cleaning liquid. An aqueous solution of nitric acid having a high concentration necessitates control of the atmosphere for safety reasons, while methanesulfonic acid is free of such a disadvantage and is therefore preferably used.

Branch lines 124 are coupled respectively to the first substrate holder cleaning bath 26*a* and the second substrate holder cleaning bath 26*b*. These branch lines 124 branch off from a rinsing liquid supply line 122 which extends from a rinsing liquid supply source 120 for supplying a rinsing liquid, such as pure water. The branch lines 124 are provided with on-off valves 126*a* and 126*b*, respectively. Further, branch lines 132, branching off from a water discharge line 130, are coupled respectively to the first substrate holder cleaning bath 26*a* and the second substrate holder cleaning bath 26*b*. The branch lines 132 are provided with on-off valves 134*a* and 134*b*, respectively.

In this embodiment at least one of the first substrate holder cleaning bath 26*a* and the second substrate holder cleaning bath 26*b* is used as a storage bath for storing substrate holders 18 therein. This can avoid an increase in the footprint of the plating apparatus. When the first substrate holder cleaning bath 26*a* is used as the storage bath, the on-off valves 108*a*, 116*a*, 126*a*, and 134*a* are all closed so that the liquids (the cleaning liquid and the rinsing liquid) will not flow into the first substrate holder cleaning bath 26*a*. When the second substrate holder cleaning bath 26*b* is used as the storage bath, the on-off valves 108*b*, 116*b*, 126*b*, 134*b* are all closed.

A description will now be given of the operation of the plating apparatus in the case where the first substrate holder cleaning bath 26*a* is used as the storage bath and substrate holders 18, stored in the first substrate holder cleaning bath 26*a*, are used in a sequence of plating process steps, while the substrate holders 18 are cleaned with the cleaning liquid in the second substrate holder cleaning bath 26*b* without removing the substrate holders 18 from the plating apparatus. In the case where the second substrate holder cleaning bath 26*b* is used as the storage bath and the substrate holders 18 are cleaned with the cleaning liquid in the first substrate holder cleaning bath 26*a*, the operation of the plating apparatus is performed in a similar manner, and hence a description thereof will be omitted.

A sequence of plating processes, performed with the use of the substrate holder 18 stored in the first substrate holder cleaning bath 26*a*, will be described first.

One substrate W is removed by the substrate transport device 22 from the substrate cassette 10 mounted to the cassette table 12, and the substrate W is placed on the aligner 14, where an orientation flat or a notch of the substrate W is aligned in a predetermined direction. After the alignment, the substrate W is transported to the substrate loading unit 20 by the substrate transport device 22.

Two substrate holders 18, which are stored in the first substrate holder cleaning bath 26*a*, are simultaneously gripped by the first transporter 42, and transported to the substrate loading unit 20. The two substrate holders 18 are lowered in a horizontal position until these substrate holders 18 are simultaneously placed on the stage plate 52 of the substrate loading unit 20. The pneumatic cylinder is then actuated to open the second holding member 58 of each of the substrate holders 18.

In this state, the substrate W that has been transported to the substrate loading unit 20 by the substrate transport device 22 is inserted into the substrate holder 18 positioned at the center side, and the pneumatic cylinder is reversely actuated to close the second holding member 58. Then the second holding member 58 is locked by means of a locking/unlocking mechanism. After completion of the loading of the substrate W into the one substrate holder 18, the stage plate 52 is slid laterally, and other substrate W is loaded into the other substrate holder 18 in the same manner. Thereafter, the stage plate 52 is returned to its original position.

With the above operations, the substrate W is held by the substrate holder 18 with its front surface (to-be-plated surface) exposed in an opening of the substrate holder 18 and its peripheral portion sealed by the sealing members 66 and 68 which prevent intrusion of a plating solution. The peripheral portion of the substrate W, which is not in contact with the plating solution, is electrically connected to the electrical contacts 88. Wires extend from the electrical contacts 88 to the hand 90 of the substrate holder 18.

Therefore, an electric current can be fed to a seed layer 200 (see FIG. 2) of the substrate W by connecting a power source to the connection terminal of the hand 90.

Next, the two substrate holders 18, loaded with the substrates W, are simultaneously gripped by the first transporter 42 and transported to the first substrate holder cleaning bath 26*a*. The two substrate holders 18 are lowered in a vertical position and suspended in the first substrate holder cleaning bath 26*a* for temporary storage. The substrate transport device 22, the substrate loading unit 20, and the first transporter 42 sequentially repeat the above operations to sequentially remove substrates W from the first substrate holder cleaning bath 26*a*, load the substrates W into substrate holders 18, and sequentially suspend the substrate holders 18 in predetermined positions in the first substrate holder cleaning bath 26*a* for their temporary storage.

Although not shown diagrammatically, instead of the substrate loading unit 20 on which two substrate holders 18 are placed in a horizontal position, it is possible to provide a fixing station which supports two substrate holders, which have been transported by the first transporter 42, in a vertical position. The substrate holders can be brought into a horizontal position by rotating the fixing station, holding the substrate holders in a vertical position, by 90 degrees. While one locking/unlocking mechanism is provided in this embodiment, it is possible to provide two locking/unlocking mechanisms and to simultaneously perform locking/unlocking of two substrate holders, disposed adjacent to each other, by means of the two locking/unlocking mechanisms.

Two substrate holders 18 loaded with substrates W, which have been temporarily stored in the first substrate holder cleaning bath 26*a*, are simultaneously gripped by the second transporter 44 and transported to the pre-wetting bath 28, where the two substrate holders 18 are lowered until they are immersed in a pre-wetting liquid (pure water) in order to enhance the hydrophilicity of the surface of the seed layer 200 (see FIG. 2) of each substrate W.

It is also possible to transport the substrate holders 18, each loaded with the substrate W, directly to the pre-wetting bath 28 to immerse the substrates together with the substrate holders 18 into the pre-wetting liquid by the first transporter 42, i.e., without temporarily storing the substrate holders 18 in the first substrate holder cleaning bath 26*a*.

Next, the two substrate holders 18 loaded with the substrates W are transported to the pretreatment bath 30 in the same manner as described above. In the pretreatment bath 30, a surface oxide film formed on the seed layer 200 (see FIG. 2) of each substrate W is etched away, thereby exposing a clean metal surface. Thereafter, the substrate holders 18 loaded with the substrates W are transported to the pretreatment solution water-cleaning bath 32, where the acid adhering to the surface (to-be-plated surface) of the substrate W is removed.

Figure 1:
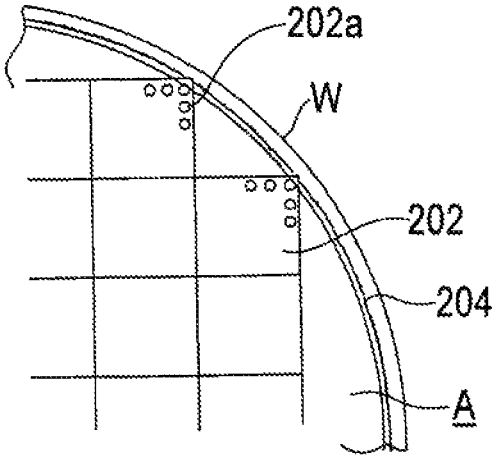
FIG. 1 (PRIOR ART)
FIG. 1 is a plan view showing a relationship between a substrate and a sealing member of a substrate holder when the substrate is held by the substrate holder, with a peripheral portion of a surface of the substrate sealed by the sealing member when plating of the substrate surface is performed.
Figure 2:
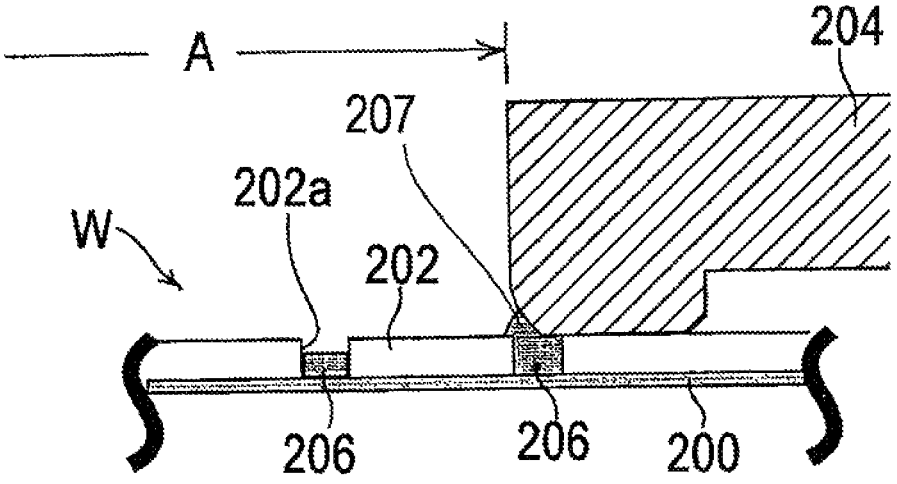
FIG. 2 (PRIOR ART)
FIG. 2 is a cross-sectional view illustrating plating of the surface of the substrate with the peripheral portion of the surface of the substrate sealed by the sealing member.

Thereafter, the two substrate holders 18 loaded with the substrates W are transported in the same manner to the Cu plating bath 34*a* in which a Cu plating solution is held, and are suspended in the Cu plating bath 34*a*. Copper plating of the surface of each substrate W is carried out in the following manner. While the Cu plating solution is supplied to the Cu plating bath 34*a* and is circulating through the Cu plating bath 34*a*, a plating voltage is applied between the substrate W and an anode (not shown) in the Cu plating bath 34*a* and, at the same time, the paddle is reciprocated parallel to the surface of the substrate W by means of the paddle driving device 46. As shown in FIG. 2, a metal 206, which is a Cu film, is formed by the copper plating on the exposed surfaces of the seed layer 200, lying inside the resist openings 202*a*, in each substrate W.

Like the sealing member 204 shown in FIG. 2, if the substrate-side sealing member 66 bridges over those resist openings 202*a* which lie in the peripheral portion of the surface of the substrate W, the metal 206 may be deposited abnormally in the resist openings 202*a* over which the substrate-side sealing member 66 bridges and may reach even the top surface of the resist 202, resulting in adhesion of the over-deposited metal 207 (Cu) to the substrate-side sealing member 66. The same problem could occur in the below-described nickel plating and Sn—Ag alloy plating. When an Ni film is formed on the surface of the Cu film by nickel plating, and when an Sn—Ag alloy film is formed on the surface of the Ni film by Sn—Ag alloy plating, a metal 206 may be deposited abnormally in those resist openings 202*a* over which the substrate-side sealing member 66 bridges and may reach even the top surface of the resist 202, resulting in adhesion of the over-deposited metal 207 (Ni and an Sn—Ag alloy) to the substrate-side sealing member 66.

It is therefore necessary to clean the substrate holder 18, periodically or as needed, to remove the metal 207 (Cu, Ni and/or an Sn—Ag alloy) from the substrate-side sealing member 66.

During the copper plating, the substrate holder 18 is suspended and fixed with the hands 90 supported on the top of the Cu plating bath 34*a*, and electricity is fed from a plating power source to the seed layer 200 (see FIG. 2) of the substrate W through the electrical conductors (electrical contacts) 86 and the electrical contacts 88. Feeding of the electricity is performed in the same manner in below-described nickel plating and Sn—Ag alloy plating.

After the completion of copper plating, the application of the plating voltage, the supply of the plating solution, and the reciprocation of the paddle are stopped. Thereafter, the two substrate holders 18 loaded with substrates W are simultaneously gripped by the second transporter 44, and are transported to the first water-cleaning bath 36*a*, where the substrates W and the substrate holders 18 are cleaned with pure water by repeating at least twice the operation of supplying pure water into the first water-cleaning bath 36*a* and draining the pure water from the bath 36*a*.

After water cleaning, the substrate holders 18 loaded with the substrates W are transported in the same manner to the Ni plating bath 34*b* in which an Ni plating solution is stored, and are suspended in the Ni plating bath 34*b*. As necessary, the second transporter 44 sequentially repeats the above operations to sequentially transport substrate holders 18, each loaded with a substrate, to the Ni plating bath 34*b* and suspend the substrate holders 18 at predetermined positions in the Ni plating bath 34*b*.

Nickel plating of the surface of each substrate W is carried out in the following manner. While the Ni plating solution is supplied into the Ni plating bath 34*b* and is circulating through the Ni plating bath 34*b*, a plating voltage is applied between the substrate W and an anode (not shown) in the Ni plating bath 34*b* and, at the same time, the paddle is reciprocated parallel to the surface of the substrate W by means of the paddle driving device 46. An Ni film is formed by the nickel plating on the surface of the Cu film which has been formed by the copper plating.

After the completion of nickel plating, the application of the plating voltage, the supply of the plating solution, and the reciprocation of the paddle are stopped. Thereafter, the two substrate holders 18 loaded with substrates W after nickel plating are simultaneously gripped by the second transporter 44, and are transported to the second water-cleaning bath 36*b*, where the substrates W and the substrate holders 18 are cleaned with pure water in the same manner as described above.

After water cleaning, the substrate holders 18 loaded with the substrates W are transported in the same manner to the Sn—Ag alloy plating bath 34*c* in which an Sn—Ag alloy plating solution is stored, and are suspended in the Sn—Ag alloy plating bath 34*c*. As necessary, the second transporter 44 sequentially repeats the above operations to sequentially transport substrate holders 18, each loaded with a substrate, to the Sn—Ag alloy plating bath 34*c* and suspend the substrate holders 18 at predetermined positions in the Sn—Ag alloy plating bath 34*c*.

Sn—Ag alloy plating of the surface of each substrate W is carried out in the following manner. While the Sn—Ag alloy plating solution is supplied into the Sn—Ag alloy plating bath 34*c* and is circulating through the Sn—Ag alloy plating bath 34*c*, a plating voltage is applied between the substrate W and an anode (not shown) in the Sn—Ag alloy plating bath 34*c* and, at the same time, the paddle is reciprocated parallel to the surface of the substrate W by means of the paddle driving device 46. An Sn—Ag alloy film is formed by the Sn—Ag alloy plating on the surface of the Ni film which has been formed by the nickel plating.

After the completion of Sn—Ag alloy plating, the application of the plating voltage, the supply of the plating solution, and the reciprocation of the paddle are stopped. Thereafter, the two substrate holders 18 loaded with substrates W are simultaneously gripped by the second transporter 44, and are transported to the third water-cleaning bath 36*c*, where the substrates W and the substrate holders 18 are cleaned with pure water in the same manner as described above.

Thereafter, the substrate holders 18 are transported to the blow bath 38, where the substrate holders 18 are cleaned with water and then air blows the substrate holders 18 to remove water droplets from the substrates W and the substrate holders 18. The substrate holders 18 are then gripped by the first transporter 42 and transported to the substrate loading unit 20, where the substrate holders 18 are placed on the stage plate 52 in the same manner as described above.

The second holding member 58 of the substrate holder 18 positioned on the center side is unlocked by means of the locking/unlocking mechanism, and the pneumatic cylinder is actuated to open the second holding member 58. The substrate W after plating is then removed from the substrate holder 18 by the substrate transport device 22, and transported to the spin drier 16, where the substrate W is spin-dried (drained) by high-speed rotation of the spin drier 16. The dried substrate W is returned to the substrate cassette 10 by the substrate transport device 22.

After or in parallel with returning the substrate to the substrate cassette 10, the stage plate 52 is slid laterally and the other substrate is removed from the other substrate holder 18. The substrate is then spin-dried by the spin drier 16, and the dried substrate is returned to the substrate cassette 10.

After returning the stage plate 52 to the original position, the two substrate holders 18, from which the substrates have been removed, are simultaneously gripped by the first transporter 42 and are returned to predetermined positions in the first substrate holder cleaning bath 26*a* in the same manner as described above. Thereafter, the two substrate holders 18, which have been returned to the first substrate holder cleaning bath 26*a*, are simultaneously gripped by the substrate holder transport device 40 and, in the same manner as described above, are placed on the stage plate 52 of the substrate loading unit 20. Thereafter, the same operations as described above are repeated.

Processes of cleaning the substrate holders 18 in the second substrate holder cleaning bath 26*b* will now be described.

One dummy substrate DW is removed from the dummy substrate cassette 24, disposed adjacent to the substrate transport device 22, by the substrate transport device 22 and, if necessary, the substrate DW is placed on the aligner 14, where an orientation flat or a notch of the dummy substrate DW is aligned in a predetermined direction. The dummy substrate DW is then transported to the substrate loading unit 20 by the substrate transport device 22.

Two substrate holders 18 stored in the first substrate holder cleaning bath 26*a* are simultaneously gripped by the first transporter 42, and transported to the substrate loading unit 20. The substrate holders 18 are lowered in a horizontal position until they are simultaneously placed onto the stage plate 52 of the substrate loading unit 20. The pneumatic cylinder is then actuated to open the second holding member 58 of each of the substrate holders 18.

The dummy substrates DW are then held by the substrate holders 18, respectively, in the same manner as the case of the substrate W. When the dummy substrate DW is held by the substrate holder 18, a space around the peripheral portion of the dummy substrate DW is sealed off by the sealing members 66 and 68 which prevent intrusion of the plating solution into the space. The electrical contacts 88 of the substrate holder 18 are located in this sealed space where the cleaning liquid is not permitted to enter.

When the dummy substrate DW is held by the substrate holder 18, a substrate contact portion 66*a* of the substrate-side sealing member 66 is wiped by the surface of the dummy substrate DW, whereby extraneous matter can be rubbed off the substrate contact portion 66*a*. Likewise, a substrate contact portion 88*a* of the electrical contact 88 is wiped by the surface of the dummy substrate DW, whereby impurities can be rubbed off the substrate contact portion 88*a*. The wiping effect due to contact with the surface of the dummy substrate DW is high especially when the dummy substrate DW is a bare silicon substrate or a substrate having a surface silicon oxide film which, as compared to the substrate W to be plated, has a higher surface hardness and a larger contact area with the substrate contact portion 66*a* of the substrate-side sealing member 66 or with the substrate contact portion 88*a* of the electrical contact 88.

Next, the two substrate holders 18, loaded with the dummy substrates DW, are simultaneously gripped by the first transporter 42 and transported to the second substrate holder cleaning bath 26*b*. The two substrate holders 18 are lowered in a vertical position until they are suspended in the second substrate holder cleaning bath 26*b*. The substrate transport device 22, the substrate loading unit 20, and the first transporter 42 sequentially repeat the above operations to sequentially load dummy substrates DW into substrate holders 18 which have been stored in the first substrate holder cleaning bath 26*a* and sequentially suspend the substrate holders 18 in predetermined positions in the second substrate holder cleaning bath 26*b*.

FIG. 8 schematically illustrates the second substrate holder cleaning bath 26*b* in which the substrate holders 18, each holding the dummy substrate DW, are suspended.

The pump 102 is then driven and only the on-off valve 108*b*, provided in the branch line 106 of the cleaning liquid supply line 104, is opened to supply a predetermined amount of a cleaning liquid (10 wt % aqueous solution of methanesulfonic acid) into the second substrate holder cleaning bath 26*b* so that the substrate holders 18, each holding the dummy substrate DW and suspended in the second substrate holder cleaning bath 26*b*, are immersed in the cleaning liquid. By immersing the substrate holders 18 in the cleaning liquid, the metal 207 (see FIG. 2) adhering to the inner peripheral surface of the substrate-side sealing member 66 of each substrate holder 18 is dissolved in the cleaning liquid and is thus removed. While the substrate holders 18 are immersed in the cleaning liquid, the cleaning liquid is preferably stirred by air bubbling or by means of a paddle.

During cleaning of the substrate holder 18 with the cleaning liquid, the dummy substrate DW is held by the substrate holder 18 with a space around the dummy substrate DW sealed off by the sealing members 66 and 68, and the electrical contacts 88 of the substrate holder 18 are located in this sealed space where the cleaning liquid does not contact. Thus, the electrical contacts 88 can be prevented from contacting the cleaning liquid and becoming wet with the cleaning liquid. After keeping the substrate holders 18 immersed in the cleaning liquid for a predetermined period of time, only the on-off valve 116*b*, provided in the branch line 114 of the cleaning liquid discharge line 112, is opened to discharge the cleaning liquid from the second substrate holder cleaning bath 26*b* so that the cleaning liquid is recovered in the cleaning liquid reservoir 110.

Next, only the on-off valve 126*b*, provided in the branch line 124 of the rinsing liquid supply line 122, is opened to supply a predetermined amount of a rinsing liquid (pure water) into the second substrate holder cleaning bath 26*b* so that the substrate holders 18 are immersed in the rinsing liquid, whereby the substrate holders 18 are rinsed. After keeping the substrate holders 18 immersed in the rinsing liquid for a predetermined period of time, only the on-off valve 134*b*, provided in the branch line 132 of the water discharge line 130, is opened to discharge the rinsing liquid from the second substrate holder cleaning bath 26*b* through the water discharge line 130.

Next, the two substrate holders 18 after cleaning in the second substrate holder cleaning bath 26*b* are simultaneously gripped by the second transporter 44 and transported to the pretreatment solution water-cleaning bath 32, where the cleaning liquid adhering to the substrate holders 18 is removed. Thereafter, the substrate holders 18 are transported to the blow bath 38, where the substrate holders 18 are cleaned with water and then air blows the substrate holders 18 to remove water droplets from the substrate holders 18.

The substrate holders 18 are then gripped by the first transporter 42 and transported to the substrate loading unit 20, where the substrate holders 18 are placed on the stage plate 52 of the substrate loading unit 20. In the same manner as in the case of the substrates W, the dummy substrates DW are removed from the substrate holders 18 by the substrate transport device 22, and transported to the spin drier 16 in a sequential manner, where the dummy substrates DW are spin-dried (drained) by high-speed rotation of the spin drier 16. The dried dummy substrates DW are returned to the dummy substrate cassette 24 by the substrate transport device 22.

The two substrate holders 18, from which the dummy substrates DW have been removed, are simultaneously gripped by the first transporter 42 and returned to predetermined positions in the second substrate holder cleaning bath 26*b*. The process of cleaning the substrate holders 18 in the second substrate holder cleaning bath 26*b* is completed when all the dummy substrates DW are removed from all the substrate holders 18 and the substrate holders 18 are returned to the second substrate holder cleaning bath 26*b*.

While both the first substrate holder cleaning bath 26*a* and the second substrate holder cleaning bath 26*b* serve not only as a cleaning unit but also as a storage bath in this embodiment, one of the first substrate holder cleaning bath 26*a* and the second substrate holder cleaning bath 26*b* may be replaced with a container having no pipes and no valves and provided solely for use as a storage bath. Thus, in this case, all the substrate holders 18 in the plating apparatus are cleaned in only one of the first substrate holder cleaning bath 26*a* and the second substrate holder cleaning bath 26*b*.

In one embodiment, the substrate holder 18 to be cleaned is suspended in the second substrate holder cleaning bath 26*b* with no dummy substrate DW held by the substrate holder 18. In another embodiment, the substrate holder 18 may be suspended in the second substrate holder cleaning bath 26*b* with the dummy substrate DW held by the substrate holder 18 immediately after the plated substrate W is removed from the substrate holder 18. This embodiment can reduce a time for loading the dummy substrate DW into the substrate holder 18.

Because the first substrate holder cleaning bath 26*a* and the second substrate holder cleaning bath 26*b* also serve as the storage bath, they are configured to store therein at least the same number of substrate holders as the number of plating baths. In an initial operating stage of the plating apparatus, the substrate holders 18 of the plating apparatus are all stored in the first substrate holder cleaning bath 26*a* or the second substrate holder cleaning bath 26*b*. When the plating apparatus is in operation at a maximum operating rate, all the substrate holders 18 may be in use for continuous operation, with no substrate holder 18 left in the first substrate holder cleaning bath 26*a* and in the second substrate holder cleaning bath 26*b*. If some (e.g., one-half) of the substrate holders 18 are cleaned in the second substrate holder cleaning bath 26*b*, main plating operations can be performed by using the remainder of the substrate holders 18, though the operating rate of the plating apparatus decreases.

It is also possible to sequentially load the dummy substrates DW into the substrate holders 18 that have been stored in the first substrate holder cleaning bath 26*a* and/or the second substrate holder cleaning bath 26*b* and to perform cleaning of the substrate holders 18, each loaded with the dummy substrate DW, in a substrate holder cleaning mode when the plating apparatus is in an idle state in which no substrate is processed.

Though in this embodiment the dummy substrates DW are stored in the dummy substrate cassette 24 disposed adjacent to the substrate transport device 22, it is also possible to mount a substrate cassette 10, in which dummy substrates are stored, on the cassette table 12 when cleaning the substrate holders 18. Thus, it is not necessary to provide the dummy substrates in the plating apparatus, and the dummy substrates can be carried into the plating apparatus just before their use for cleaning of the substrate holders 18.

The cleaning liquid tank 100 may be installed either in the plating apparatus, or outside the apparatus as a cleaning liquid supply unit. The cleaning liquid, if it is not reusable for cleaning of substrate holders 18, may be discarded without recovering it in the cleaning liquid reservoir 110.

Figure 9:
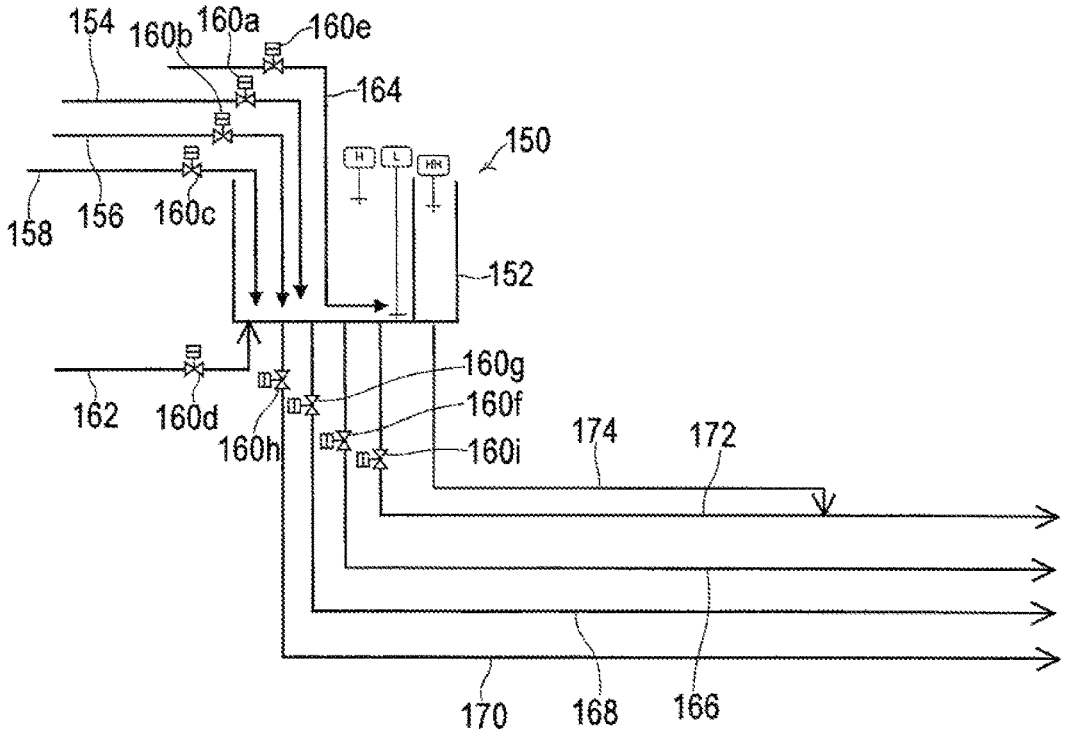
FIG. 9 is a schematic view of another substrate holder cleaning bath.

FIG. 9 illustrates a substrate holder cleaning bath 150 provided instead of at least one of the substrate holder cleaning baths 26*a* and 26*b*.

The substrate holder cleaning bath 150 of this embodiment can effectively dissolve and remove a metal 207 (see FIG. 2), adhering to the substrate-side sealing member 66 of the substrate holder 18 and composed of different types of metals, in particular Cu, Ni, and Sn—Ag alloy in this embodiment, by using different types of cleaning liquids. The use of the substrate holder cleaning bath 150 can eliminate the use of a plurality of cleaning baths for different types of cleaning liquids, thus avoiding a considerable increase in the footprint of the plating apparatus.

As shown in FIG. 9, the substrate holder cleaning bath 150 of this embodiment is provided with an overflow bath 152. A first cleaning liquid supply line 154, a second cleaning liquid supply line 156, and a third cleaning liquid supply line 158 are coupled to the substrate holder cleaning bath 150. The first cleaning liquid supply line 154 is provided for supplying a first cleaning liquid capable of dissolving and removing copper. The first cleaning liquid is, for example, a mixture of 10 wt % aqueous solution of sulfuric acid and 3 wt % aqueous solution of hydrogen peroxide. The second cleaning liquid supply line 156 is provided for supplying a second cleaning liquid capable of dissolving and removing nickel. The second cleaning liquid is, for example, a 5 wt % aqueous solution of sodium hydroxide. The third cleaning liquid supply line 158 is provided for supplying a third cleaning liquid capable of dissolving and removing an Sn—Ag alloy. The third cleaning liquid is, for example, a 10 wt % aqueous solution of methanesulfonic acid.

The first cleaning liquid supply line 154, the second cleaning liquid supply line 156, and the third cleaning liquid supply line 158 are provided with on-off valves 160*a*, 160*b*, and 160*c*, respectively.

A rinsing liquid supply line 162 for supplying a rinsing liquid, such as pure water, is coupled to the substrate holder cleaning bath 150. This rinsing liquid supply line 162 is provided with an on-off valve 160*d*. An air supply line 164 for supplying air into a liquid, such as the first cleaning liquid, in the substrate holder cleaning bath 150 in order to form bubbles in the liquid, is coupled to the substrate holder cleaning bath 150. The air supply line 164 is provided with an on-off valve 160*e*.

Further, a first cleaning liquid discharge line 166, a second cleaning liquid discharge line 168, a third cleaning liquid discharge line 170, and a water discharge line 172 are coupled to the substrate holder cleaning bath 150. The first cleaning liquid discharge line 166 is provided for discharging the first cleaning liquid from the substrate holder cleaning bath 150, the second cleaning liquid discharge line 168 is provided for discharging the second cleaning liquid from the substrate holder cleaning bath 150, and the third cleaning liquid discharge line 170 is provided for discharging the third cleaning liquid from the substrate holder cleaning bath 150. The first cleaning liquid discharge line 166, the second cleaning liquid discharge line 168, the third cleaning liquid discharge line 170, and the water discharge line 172 are provided with on-off valves 160*f*, 160*g*, 160*h*, and 160*i*, respectively. An overflow water discharge line 174 which joins the water discharge line 172 is coupled to the bottom of the overflow bath 152.

Process of cleaning the substrate holders, each having the substrate-side sealing member 66 (see FIG. 7) to which a metal 207 (see FIG. 2) composed of Cu, Ni, and an Sn—Ag alloy is attached, by using the substrate holder cleaning bath 150 having the above construction will now be described.

First, the substrate holders, each loaded with a dummy substrate, are suspended in the substrate holder cleaning bath 150 in the same manner as the above-described manner in which substrate holders 18, each loaded with the dummy substrate DW, are suspended in the second substrate holder cleaning bath 26*b*.

Next, only the on-off valve 160*a* of the first cleaning liquid supply line 154 is opened to supply a predetermined amount of the first cleaning liquid (a mixture of 10 wt % aqueous solution of sulfuric acid and 3 wt % aqueous solution of hydrogen peroxide) into the substrate holder cleaning bath 150 so that the substrate holders, each holding the dummy substrate and suspended in the substrate holder cleaning bath 150, are immersed in the first cleaning liquid and cleaned with the first cleaning liquid. The metal 207 (mainly its Cu portion), adhering to the substrate-side sealing member 66 of each substrate holder, is effectively dissolved in the first cleaning liquid and is thus removed. During the cleaning of the substrate holders, if necessary, the on-off valve 160*e* of the air supply line 164 may be opened to supply air into the first cleaning liquid to form air bubbles in the first cleaning liquid. After keeping the substrate holders immersed in the first cleaning liquid for a predetermined period of time, only the on-off valve 160*f* of the first cleaning liquid discharge line 166 is opened to discharge the first cleaning liquid from the substrate holder cleaning bath 150.

Next, only the on-off valve 160*d* of the rinsing liquid supply line 162 is opened to supply a predetermined amount of the rinsing liquid (pure water) into the substrate holder cleaning bath 150 so that the substrate holders are immersed in the rinsing liquid, whereby the substrate holders are rinsed. During the rinsing of the substrate holders, if necessary, the on-off valve 160*e* of the air supply line 164 may be opened to supply air into the rinsing liquid to form air bubbles in the rinsing liquid. After keeping the substrate holders immersed in the rinsing liquid for a predetermined period of time, only the on-off valve 160*i* of the water discharge line 172 is opened to discharge the rinsing liquid from the substrate holder cleaning bath 150 through the water discharge line 172.

Next, only the on-off valve 160*b* of the second cleaning liquid supply line 156 is opened to supply a predetermined amount of the second cleaning liquid (5 wt % aqueous solution of sodium hydroxide) into the substrate holder cleaning bath 150 so that the substrate holders, each holding the dummy substrate and suspended in the substrate holder cleaning bath 150, are immersed in the second cleaning liquid and cleaned with the second cleaning liquid. The metal 207 (mainly its Ni portion), adhering to the substrate-side sealing member 66 of each substrate holder, is effectively dissolved in the second cleaning liquid and is thus removed. During the cleaning of the substrate holders, if necessary, the on-off valve 160*e* of the air supply line 164 may be opened to supply air into the second cleaning liquid to form air bubbles in the second cleaning liquid. After keeping the substrate holders immersed in the second cleaning liquid for a predetermined period of time, only the on-off valve 160*g* of the second cleaning liquid discharge line 168 is opened to discharge the second cleaning liquid from the substrate holder cleaning bath 150.

Next, only the on-off valve 160*d* of the rinsing liquid supply line 162 is opened to supply a predetermined amount of the rinsing liquid (pure water) into the substrate holder cleaning bath 150 so that the substrate holders are immersed in the rinsing liquid, whereby the substrate holders are rinsed. After keeping the substrate holders immersed in the rinsing liquid for a predetermined period of time, only the on-off valve 160*i* of the water discharge line 172 is opened to discharge the rinsing liquid from the substrate holder cleaning bath 150 through the water discharge line 172.

Next, only the on-off valve 160*c* of the third cleaning liquid supply line 158 is opened to supply a predetermined amount of the third cleaning liquid (10 wt % aqueous solution of methanesulfonic acid) into the substrate holder cleaning bath 150 so that the substrate holders, each holding the dummy substrate and suspended in the substrate holder cleaning bath 150, are immersed in the third cleaning liquid and cleaned with the third cleaning liquid. The metal 207 (mainly its Sn—Ag alloy portion), adhering to the substrate-side sealing member 66 of each substrate holder, is effectively dissolved in the third cleaning liquid and is thus removed. During the cleaning of the substrate holders, if necessary, the on-off valve 160*e* of the air supply line 164 may be opened to supply air into the third cleaning liquid to form air bubbles in the third cleaning liquid. After keeping the substrate holders immersed in the third cleaning liquid for a predetermined period of time, only the on-off valve 160*h* of the third cleaning liquid discharge line 170 is opened to discharge the third cleaning liquid from the substrate holder cleaning bath 150.

Next, only the on-off valve 160*d* of the rinsing liquid supply line 162 is opened to supply a predetermined amount of the rinsing liquid (pure water) into the substrate holder cleaning bath 150 so that the substrate holders are immersed in the rinsing liquid, whereby the substrate holders 18 are rinsed. After keeping the substrate holders immersed in the rinsing liquid for a predetermined period of time, only the on-off valve 160*i* of the water discharge line 172 is opened to discharge the rinsing liquid from the substrate holder cleaning bath 150 through the water discharge line 172.

Next, as with the substrate holders 18 after cleaning in the second substrate holder cleaning bath 26*b*, the substrate holders after cleaning are transported to the pretreatment solution water-cleaning bath 32 (see FIG. 3), where the cleaning liquid adhering to the substrate holders is removed. Thereafter, the substrate holders are transported to the blow bath 38 (see FIG. 3), where the substrate holders are cleaned with water and air blows the substrate holders to remove water droplets from the substrate holders. The dummy substrates are removed from the substrate holders by the substrate transport device 22 (see FIG. 3), and then transported to the spin drier 16 (see FIG. 3) in a sequential manner, where the dummy substrates are spin-dried (drained) by high-speed rotation of the spin drier 16. The dried dummy substrates are returned to the dummy substrate cassette 24 (see FIG. 3) by the substrate transport device 22. The substrate holders, from which the dummy substrates have been removed, are sequentially returned to predetermined positions in the substrate holder cleaning bath 150.

The substrate holder cleaning bath 150 of this embodiment can perform cleaning of the substrate holder with the use of different types of cleaning liquids capable of effectively dissolving and removing different types of metals adhering to the sealing member of the substrate holder, making it possible to eliminate the use of a plurality of cleaning baths for different types of cleaning liquids and thus to avoid a considerable increase in the footprint of the plating apparatus.

While the present invention has been described with reference to preferred embodiments, it is understood that the present invention is not limited to the embodiments described above, but is capable of various changes and modifications within the scope of the inventive concept as expressed herein.

What is claimed is:

1. A method of cleaning a substrate holder comprising:

suspending a substrate holder in a substrate holder cleaning bath, the substrate holder holding a dummy substrate with a sealing member sealing a peripheral portion of the dummy substrate, the dummy substrate having a larger area of contact with a substrate contact portion of the sealing member and having a larger area of contact with a substrate contact portion of an electrical contact of the substrate holder than those of a substrate to be plated; and supplying a cleaning liquid into the substrate holder cleaning bath until the substrate holder is immersed in the cleaning liquid to clean the substrate holder.

2. The method according to claim 1, wherein different types of cleaning liquids are individually and sequentially supplied into the substrate holder cleaning bath to clean the substrate holder sequentially with the cleaning liquids.

3. A method of cleaning a substrate holder comprising:

suspending a substrate holder in a substrate holder cleaning bath, the substrate holder holding a dummy substrate with a sealing member sealing a peripheral portion of the dummy substrate; and supplying a cleaning liquid into the substrate holder cleaning bath until the substrate holder is immersed in the cleaning liquid to clean the substrate holder, wherein different types of cleaning liquids are individually and sequentially supplied into the substrate holder cleaning bath to clean the substrate holder sequentially with the cleaning liquids, and wherein the cleaning liquids comprise a first cleaning liquid containing a mixture of sulfuric acid and hydrogen peroxide solution, a second cleaning liquid containing an aqueous solution of sodium hydroxide, and a third cleaning liquid containing methanesulfonic acid, and said supplying a cleaning liquid into the substrate holder cleaning bath comprises:

supplying the first cleaning liquid into the substrate holder cleaning bath until the substrate holder, holding the dummy substrate, is immersed in the first cleaning liquid to clean the substrate holder;

supplying the second cleaning liquid into the substrate holder cleaning bath until the substrate holder, holding the dummy substrate, is immersed in the second cleaning liquid to clean the substrate holder; and supplying the third cleaning liquid into the substrate holder cleaning bath until the substrate holder, holding the dummy substrate, is immersed in the third cleaning liquid to clean the substrate holder.

4. The method according to claim 3, further comprising supplying a rinsing liquid into the substrate holder cleaning bath until the substrate holder, holding the dummy substrate, is immersed in the rinsing liquid to rinse the substrate holder, the rinsing liquid being supplied after supplying the first cleaning liquid and before supplying the second cleaning liquid, or after supplying the second cleaning liquid and before supplying the third cleaning liquid.

* * * * *